US007201405B2

(12) United States Patent
Le et al.

(10) Patent No.: US 7,201,405 B2
(45) Date of Patent: Apr. 10, 2007

(54) INERTIA-ACTIVATED MECHANISM

(75) Inventors: John M. Le, Tinley Park, IL (US); Stephen J. Milchuck, Jr., Manhattan, IL (US); Craig W. Gurtatowski, Merrillville, IN (US); Paul G. Ledebuhr, Columbus, IN (US)

(73) Assignee: Illinois Tool Works Inc., Glenview, IL (US)

( * ) Notice: Subject to any disclaimer, the term of this patent is extended or adjusted under 35 U.S.C. 154(b) by 190 days.

(21) Appl. No.: 10/994,792

(22) Filed: Nov. 22, 2004

(65) Prior Publication Data

US 2005/0184537 A1 Aug. 25, 2005

Related U.S. Application Data

(60) Provisional application No. 60/546,746, filed on Feb. 23, 2004.

(51) Int. Cl.
*E05B 65/10* (2006.01)

(52) U.S. Cl. ..... 292/93; 292/DIG. 22

(58) Field of Classification Search ..... 292/92, 292/93, DIG. 65, DIG. 22
See application file for complete search history.

(56) References Cited

U.S. PATENT DOCUMENTS 3,990,531 A * 11/1976 Register ..... 180/281
5,425,568 A * 6/1995 Sliney et al. ..... 297/378.11
5,438,855 A * 8/1995 Ikeda ..... 70/279.1
5,769,471 A * 6/1998 Suzuki et al. ..... 292/336.3
5,813,726 A * 9/1998 Husted ..... 297/378.11
6,880,867 B2 4/2005 Schoen et al.

FOREIGN PATENT DOCUMENTS

DE 198 58 414 A1 6/2000
EP 1128 004 A2 2/2001

* cited by examiner

*Primary Examiner*—Gary Estremsky
(74) *Attorney, Agent, or Firm*—Mark W. Croll; Paul F. Donovan

(57) ABSTRACT

An inertia activated mechanism that may be incorporated with a door handle assembly and counteracts a crash force. When the crash force is applied, a locking tab is in a lock position to prevent a latch mechanism from releasing and opening the vehicle door. When the crash force is removed, the locking tab returns to a normal position, allowing the latch mechanism to function normally. The locking tab is attached to a weight by a cable. The weight moves and causes displacement of the locking tab when the crash force is applied and is restrained by a spring when the crash force is removed.

32 Claims, 8 Drawing Sheets

INERTIA-ACTIVATED MECHANISM

CROSS REFERENCE TO RELATED APPLICATION

This Non-Provisional Application claims benefit to U.S. Provisional Application Ser. No. 60/546,746 filed Feb. 23, 2004.

FIELD OF THE INVENTION

The present invention relates generally to an apparatus that resists the unlatching of a door of a vehicle if the vehicle is involved in a crash. In particular, the invention is directed to an apparatus that may be used with a door handle assembly to counteract forces of inertia caused by a multiple vehicle crash.

BACKGROUND OF THE INVENTION

It is known that if a vehicle door opens during a crash, the driver or passenger may sustain injuries that are additional to the injuries directly related to the impact. In order to prevent a vehicle door from opening during a crash, mechanisms have been installed on the door handle assembly to prevent the door from unlatching or opening during a crash. For example, it is known to install a counterweight to the door handle assembly and particular in a position opposite to the handle pivot of the door handle. While this assembly and technique has been mostly effective in a side impact crash, it has not been as effective during a multiple axis vehicle crash. In fact, in a multiple axis vehicle crash, the inertia caused by a rollover crash, for example, may place the counterweight in a position that permits the door to be unlatched and opened. The present invention is directed at overcoming these and other known drawbacks with respect to existing door latching mechanisms.

SUMMARY OF THE INVENTION

The present invention is directed to a mechanism that counteracts forces of inertia caused by a vehicle crash, including a multiple axis crash. The mechanism of the invention is also called an inertia activated mechanism and may be incorporated with a door handle assembly of a vehicle. With one aspect of the invention, the inertia activated mechanism of the invention will prevent the latch mechanism, which releases the door, from releasing and the door opening during a multiple axis crash. After the crash, or when the crash force is removed, the inertia activated mechanism of the invention will allow the latch mechanism to function normally, thereby permitting the door to be opened and the occupants to exit from the vehicle.

Other features and advantages of the invention will become apparent to those skilled in the art upon review of the following detailed description, claims and drawings in which like numerals are used to designate like features.

Figure 1:
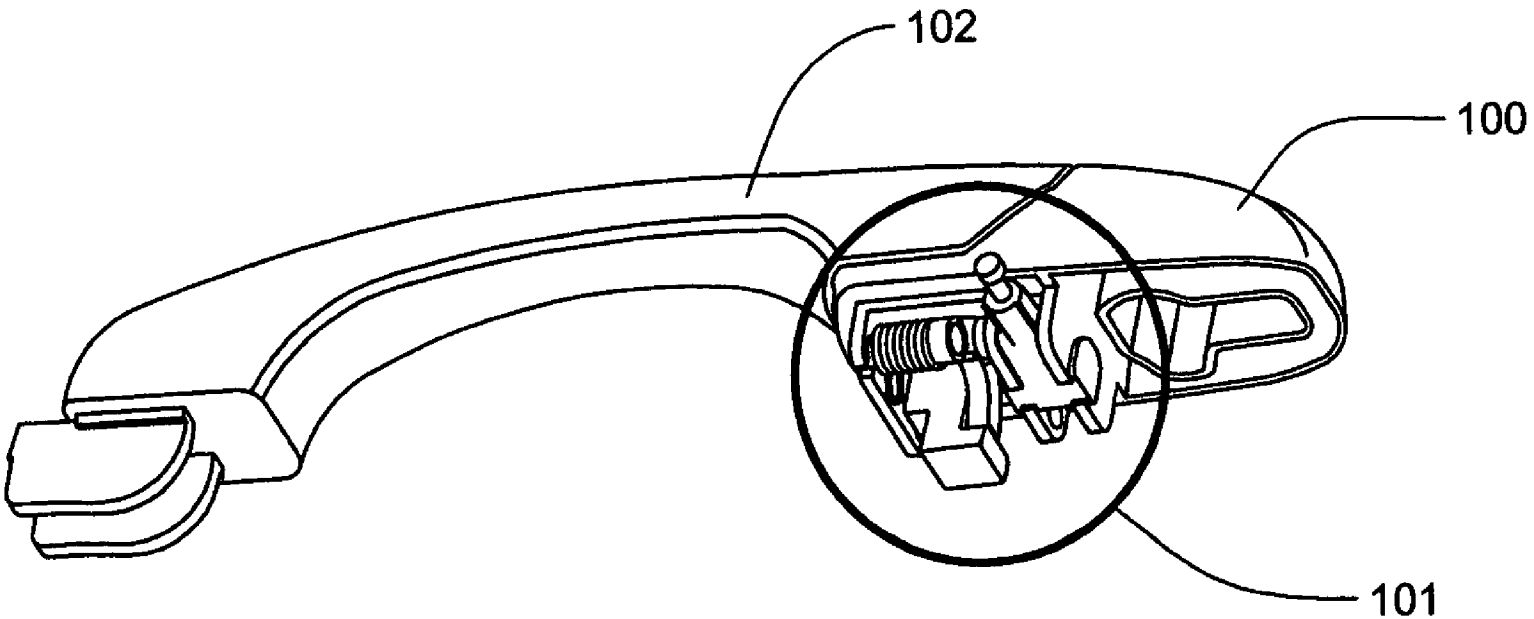
FIG. 1 shows a door handle assembly incorporating an inertia activated assembly according to an embodiment of the invention.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE EMBODIMENTS

The present invention is directed to an inertia activated mechanism that can be used in any vehicle door handle assembly to counteract forces of inertia caused by multiple axis vehicle crashes. Referring to FIG. 1, an exemplary door handle assembly 100 is depicted that includes an inertia activated assembly 101 according to an embodiment of the invention and a door handle 102. The inertia activated assembly 101 may be incorporated into a current production door handle with minimal or no changes to the surrounding environment, or may be incorporated into a specially-designed door handle.

As will be discussed below, the inertia activated assembly 101 causes the latching mechanism of door handle assembly 100 to resist releasing of the door when a force is applied during a vehicle crash, including forces from a multiple axis crash, such as a rollover crash.

Figure 5:
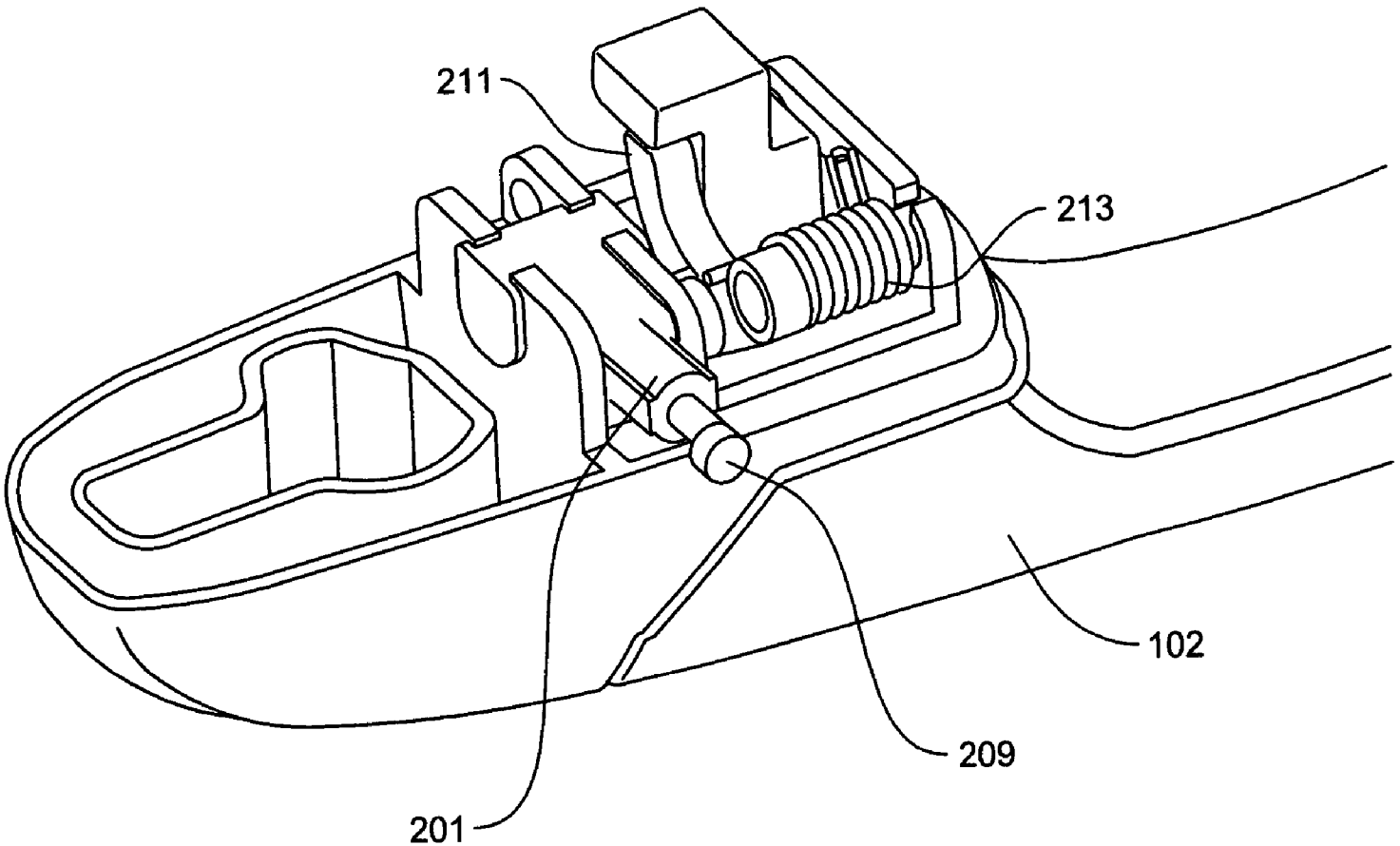
FIG. 5 shows another view of the handle assembly incorporating the inertia activated assembly of an embodiment of the invention.
Figure 6:
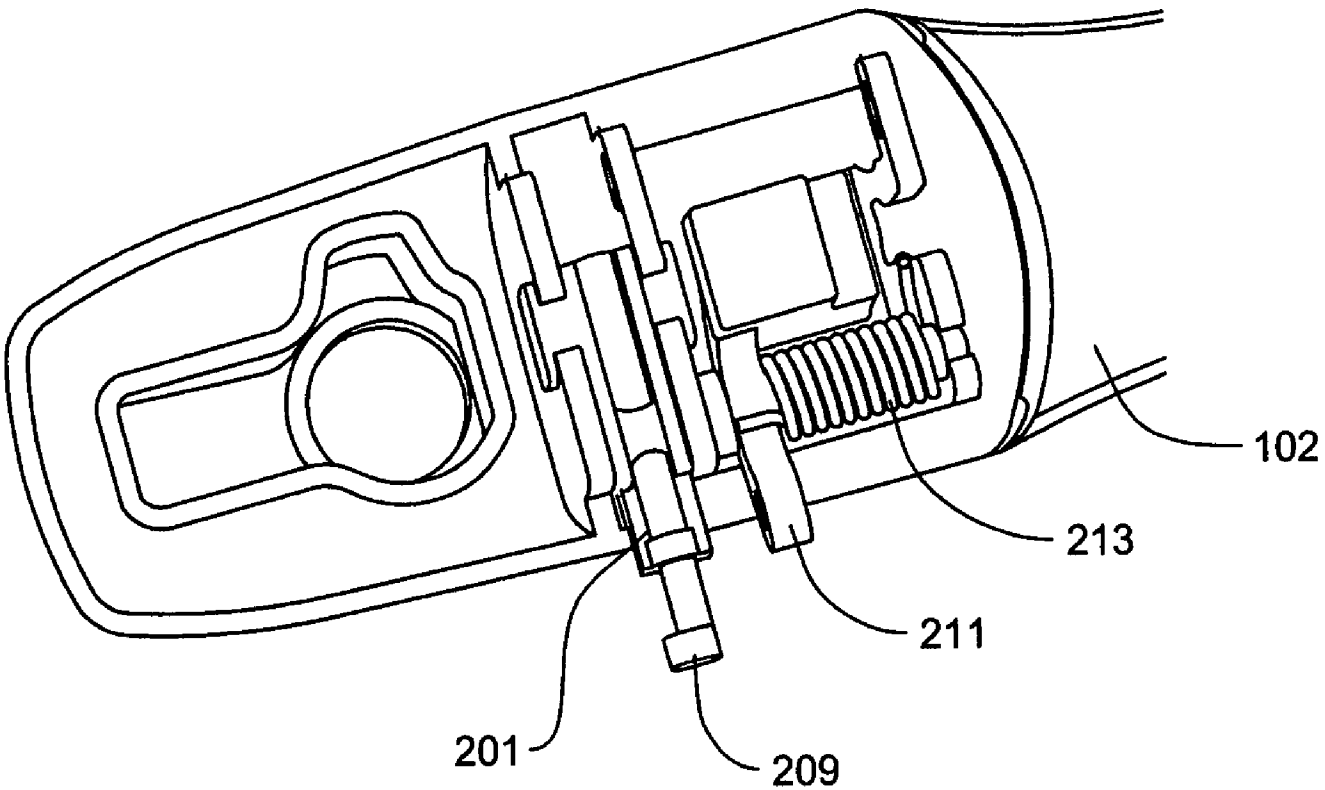
FIG. 6 shows a top view of the assembly of FIG. 5.
Figure 7:
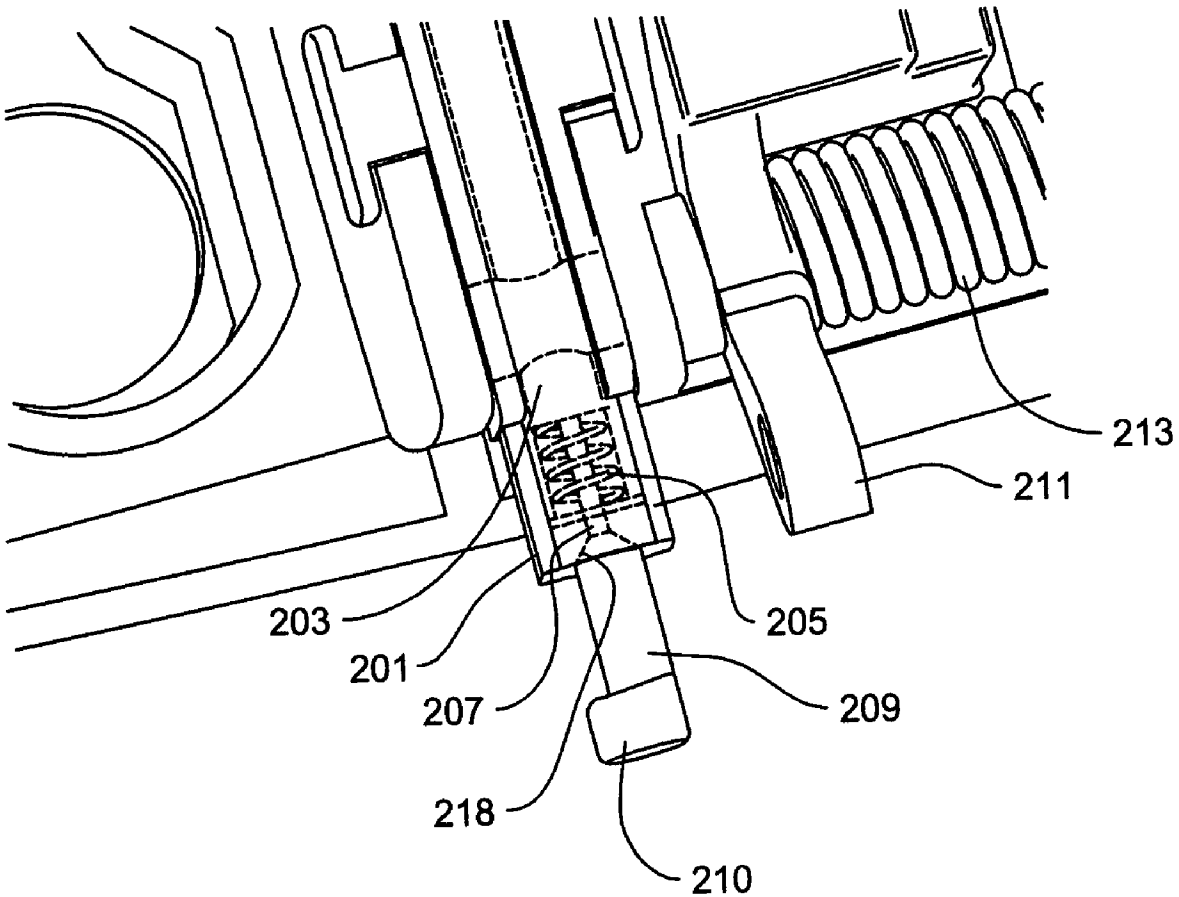
FIG. 7 shows a close-up view of the assembly depicted in FIG. 6 with a partial removal of the housing to illustrate the components of the inertia activated mechanism.
Figure 8:
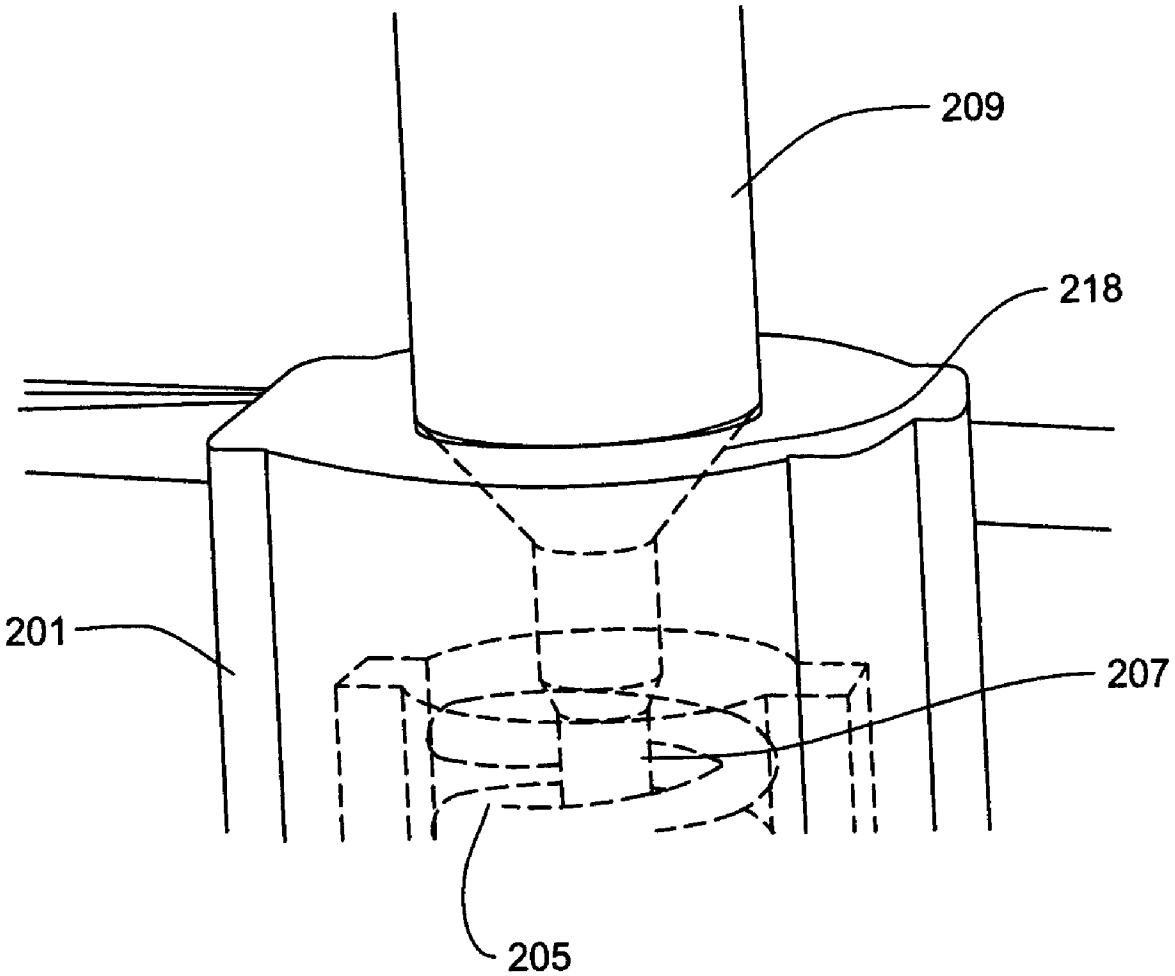
FIG. 8 shows a close-up, partial view of the components of FIG. 3 mounted within the housing of the inertia activated mechanism of FIG. 2.

Referring to FIGS. 2–8, an exemplary inertia activated mechanism 200 includes a housing 201, a locking tab or blade 203, a spring 205, a cable 207, and a weight component 209 that has an off-center weight 210. The locking tab 203, spring 205, cable 207, and weight component 209 may be individual components that are assembled together. These components may be housed within the housing 201 (FIG. 2) that is disposed in the latch assembly body, as shown in FIGS. 5 and 6. The locking tab 203 and cable 207 are permitted to move within the housing 201; however, this movement is constrained or limited by the spring 205, as discussed below.

The housing 201 is configured to mount into current production door handles (e.g., handle 102) or may be incorporated into a specially-designed door handle. The housing 201 includes a hole 218 extending through the housing body. The hole 218 defines a conical-shaped end and serves to receive the locking tab 203, spring 205, and cable 207. The invention is not limited by the shape and configuration of the housing 201. Consequently, other shapes and configurations of the housing are possible, as illustrated by the embodiment illustrated in FIGS. 9 and 10, discussed below. The housing 201 also includes an opening 221 through its side wall. The opening 221 receives a knob 212 of a pivoting cam 211, as discussed below.

Figure 3:
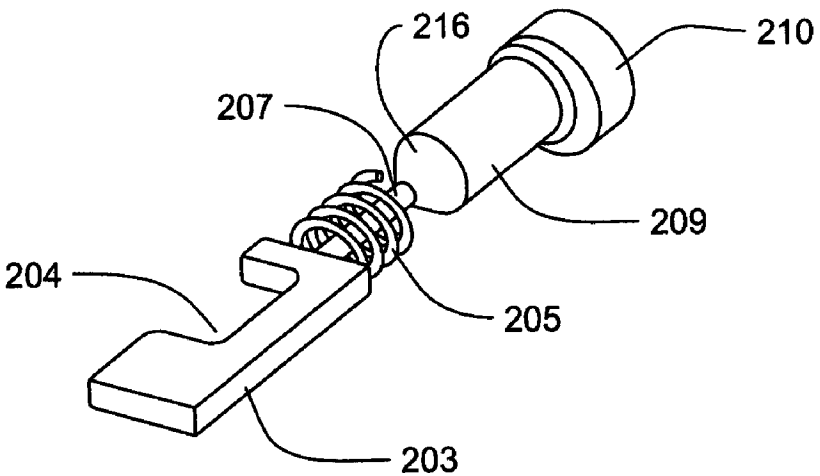
FIG. 3 shows components of the inertia activated mechanism of FIG. 2.
Figure 2:
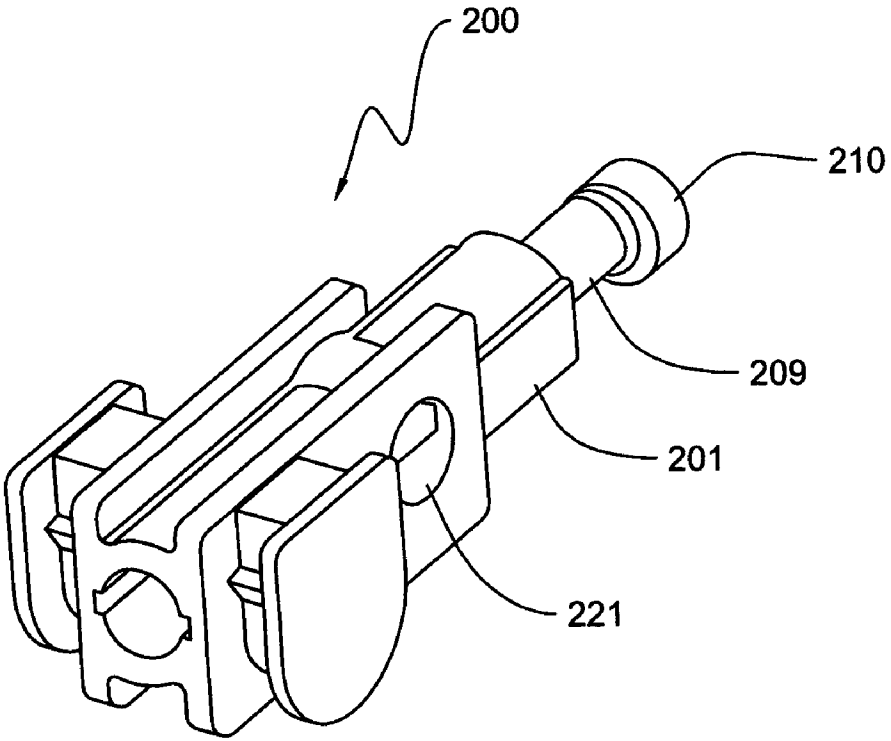
FIG. 2 shows an inertia activated mechanism according to an embodiment of the invention.
Figure 4:
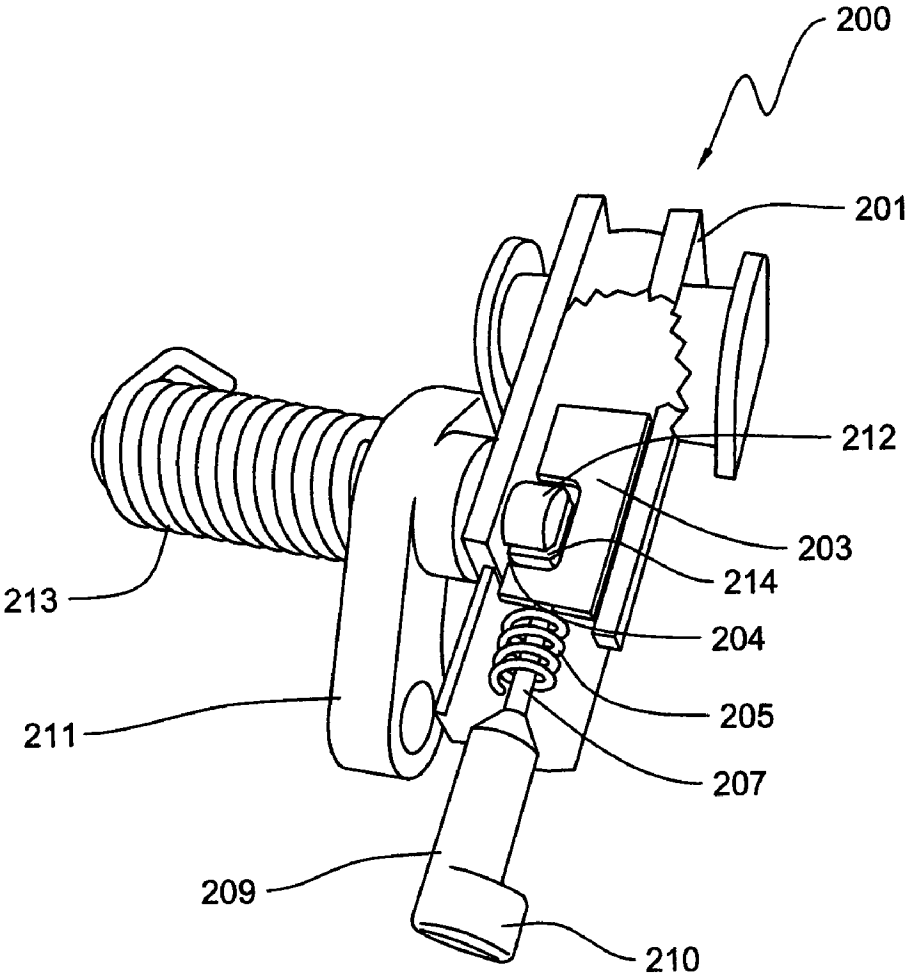
FIG. 4 shows the inertia activated mechanism of FIG. 2 with a partial removal of the housing to illustrate the mounting of the components of FIG. 3 to the door handle latching components.

Referring to FIG. 3, the cable 207, which in one embodiment is made of a flexible material, is attached to both the locking tab 203 and the weight component 209. In an exemplary embodiment, the locking tab 103 is insert molded onto one end of the cable 207. The weight component 209 and weight 210 are crimped or otherwise secured onto the other end of the cable 207. The weight 210 is part of the weight component 209 and is off-center with respect to the axis of the cable 207 to ensure that forces will not directly offset during a crash. That is, as described below, as the weight component 209 moves outward and away from the housing during a crash, the off-center weight 210 causes the weight component to move outward and away in a non-linear or angular direction. The weight component 209 is generally tubular in shape and has a cone-shaped end section 216 that approximately matches the cone-shaped opening of the hole 218 of the housing 201. The cable 207 is threaded through the spring 205, which may be a coil spring.

The locking tab 203 is generally planar in shape and defines a cut-out or opening 204 that, as will be described below, will be positioned around the knob 212 of the pivoting cam 211 to permit the pivoting cam to rotate freely during non-crash conditions. The pivoting cam 211 is operatively connected to the door latch mechanism as understood by those skilled in the art. As the cam 211 rotates, as a result of the operation of the door handle, the cam 211 will cause or permit the door latch mechanism to release, thereby opening the door. As more fully described below, during a crash condition, the locking tab 203 will engage a slot 214 in the knob 212 to prevent the pivoting cam 211 from rotating and thus preventing the door latch mechanism from operating to open the door.

More specifically, in operation, due to the off-center configuration of the weight component 209, coupled with its movement relative to the housing, the latching mechanism of the door handle will be restricted from opening in a multiple axis vehicle crash. In particular, the spring force of spring 205 restrains the weight component 209 in a home position, that is, with the weight component 209 seated against the housing 201. When a greater force (corresponding to a vehicle crash) is imposed on the weight component 209, thus setting the weight component 209 into motion, the weight component 209 will travel away from the housing 201 and overcome the spring force of the spring 205 causing the cable 207 to displace the locking tab 203 into a lock position. When in the lock position, the locking tab 203 will be positioned within the slot 214 formed in the knob 212 of the cam 211. This will prevent the cam 211 from rotating and thus preventing the latch mechanism to release and open the door. When no further forces are acting upon the weight component 209, it will return to its home position through the spring force of the spring 205. In this position, the latch mechanism of the door handle is allowed to function normally.

Stated another way, during a crash, the resulting crash force is typically greater than the spring force of the spring 205, which functions to hold the weight component 209 next to the housing 201. The weight component 209 will travel outward from the cone-shaped hole 218 in the housing 201 and away from the housing 201. The weight component 209 thus pulls the locking tab 203 in such a manner that the locking tab engages the slot 214 provided in the knob 212 on the pivoting cam 211. When so positioned, the pivoting cam 211 cannot rotate, thereby preventing the door latch from being opened. Stated more generally, during a crash, the weight component will move causing the locking tab to move and lock the cam in position preventing the door from opening. Also during a crash, given the flexible nature of the cable 207, the weight component 209 moves at an angle relative to the housing. The resulting angular movement prevents the locking tab 203 from moving back into a position that would allow the pivoting cam 211 to rotate.

When the vehicle is not moving or when it is desirable to open the door (i.e., when the vehicle is not involved in a crash situation), the cut-out or opening 204 in the locking tab 203 is positioned around the knob 212 and slot 214 located on the pivoting cam 211. In this configuration, the pivoting cam 211 can rotate to allow the door to be unlatched so the door can be opened. The handle spring 213 causes the door handle 102 to return to its closed position when the door handle is released.

In an exemplary embodiment, the housing 201 defines the hole 218 that is conical shaped. This shape and the cone-shaped surface of the weight component 209 will result in the weight component 209 not bending over during a crash. The cone-shaped surfaces will also ensure that the weight component 209 moves during a crash. Moreover, the cone-shaped surfaces help protect the cable 207 from wear.

As stated above, in an exemplary embodiment, the weight 210 is off-center from the longitudinal axis of the cable 207 in the static position. This will ensure that during a crash the forces will not be directly offset (i.e., cancel each other out), which, if did occur, could possibly leave the locking tab 203 unmoved and thus allow the pivoting cam 211 to rotate and the door to be opened. In other words, the forces caused by a multiple axis crash will not cancel each other out because the off-center weight 210 will necessarily move during a crash, thereby causing movement of the locking tab 203 to lock the cam 211 in position.

Figure 10:
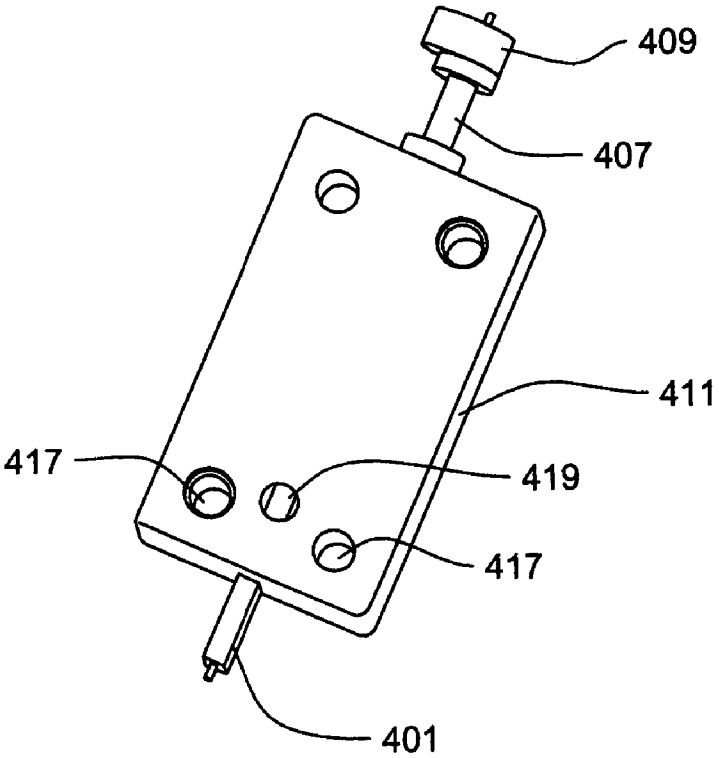
FIG. 10 shows another view of the inertia activated mechanism of FIG. 9.
Figure 9:
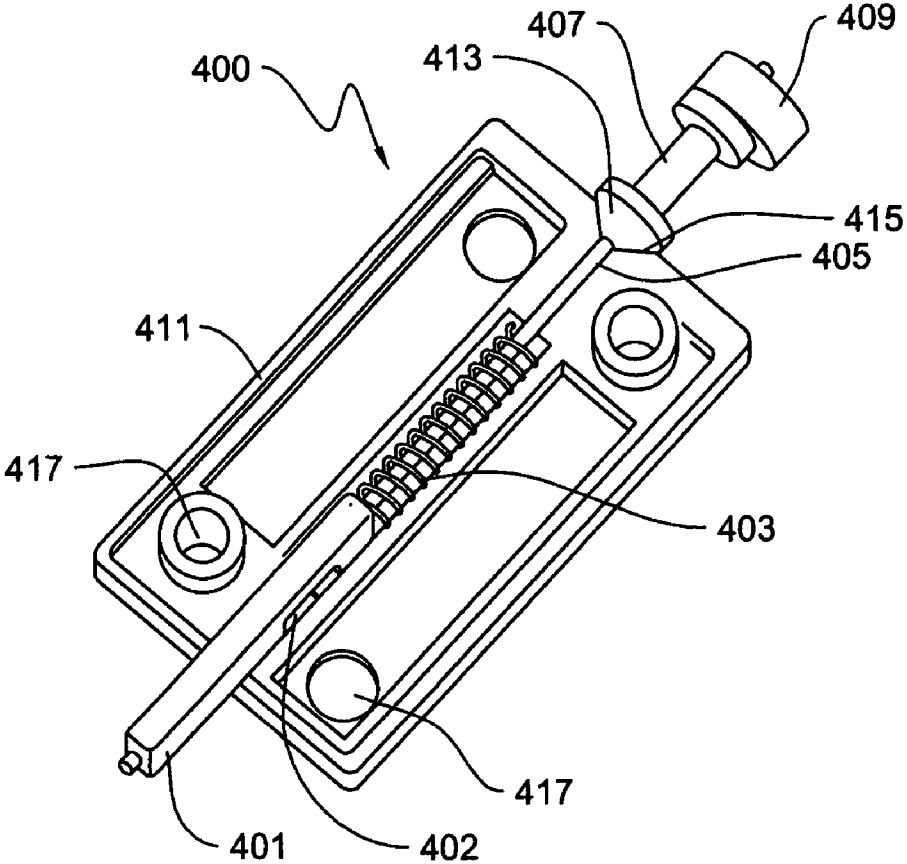
FIG. 9 shows an inertia activated mechanism according to another embodiment of the invention.

Referring to FIGS. 9 and 10, there is depicted an inertia activated mechanism 400 according to another embodiment of the invention. The inertia activated mechanism 400 includes a locking tab or blade 401, a spring 403, a cable 405, a barbell-shaped weight portion 407, an off-center weight 409, and a housing 411. Similar to the other embodiment, the locking tab 401 includes a cut-out 402 that, as assembled, will be positioned around the knob 212 of the pivoting cam 211, as described above. Referring to FIG. 9 where a top-half of the housing 411 is removed, the barbell-shaped weight portion 407 has a cone-shaped section 413 that approximately matches a cone-shaped hole 415 that is formed by the housing 411.

In the embodiment, the locking tab 401 and barbell-shaped portion 407 are insert molded over the cable 405 so that the locking tab 401, barbell-shaped portion 407, spring 403, and cable 405 can be removed from the mold when assembled together. The weight 409 may be crimped into place or otherwise secured on the cable 405.

The inertia activated mechanism 400 will function in a manner similar to the embodiment described above. That is, during non-crash conditions, the knob 212 of the pivoting cam 211 will rotate freely within the cut-out 402 of the locking tab 401. During a crash condition, as the weight 409 moves away from the housing 411, the weight 409, which is connected to the locking tab 401 via the cable 405, will pull on the locking tab 401 causing the locking tab 401 to engage the slot 214 located on the knob 212 of the pivoting cam 211. Under this condition, the pivoting cam 211 will be prevented from rotating and thus the door will be prevented from opening during a crash. When the crash condition is over, the spring force of the spring 403 causes the locking tab 401 to disengage from the slot 214 on the knob 212 and to return to its home position thus permitting the cam 211 to rotate freely and the door to be opened.

FIG. 10 shows the position of the barbell-shaped portion 407 and weight 409 with respect to the housing 411. The housing 411 comprises two housing halves each having mounting holes 417 that permit the two housing halves to be joined together and to other structures through the use of fasteners or the like. The components of the inertia activated mechanism 400 are placed in one of the housing halves and the other housing half is placed over to form the housing 411. In the embodiment, both housing halves are substantially the same and interchangeable. As depicted in FIG. 10, one of the housing halves includes an opening 419 to receive the knob 212 of the pivoting cam 211. The inertia activated mechanism 400 is configured to mount into current production door handles (e.g., handle 102) or may be incorporated into a specially-designed door handle.

Variations and modifications of the foregoing are within the scope of the present invention. It should be understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. An inertia activated mechanism, the inertia activated mechanism coupled to a door latch mechanism in a door of a vehicle, comprising:

a housing defining an aperture;

a weight component that is mounted to the housing through the aperture, that is displaced when a crush force is applied to the weight, and that returns to a home position when the crash force is removed, wherein the crash force results from a crash of the vehicle;

a spring that restrains the weight from moving when the crash force is not applied;

a locking tab that resists the door latch mechanism from opening the door when the locking tab engages a latch component of the door latch mechanism; and a cable that attaches to the weight component at one end and to the locking tab at the other end and that causes the locking tab to engage the latch component when the weight component is displaced.

2. The inertia motivated mechanism of claim 1, wherein the aperture includes a cone-shaped surface and wherein the weight component has a cone-shaped section.

3. The inertia activated mechanism of claim 2, wherein the weight component moves at an angle to the housing when the weight component travels away from housing.

4. The inertia activated mechanism of claim 1, wherein the latch component of the door latch mechanism comprises a pivoting cam.

5. The inertia activated mechanism of claim 4, wherein the pivoting cam comprises a knob, wherein a slot is located in the knob, and wherein the locking tab engages the slot when the weight component is displaced.

6. The inertia activated mechanism of claim 5, wherein an opening of the locking tab is positioned around the knob and the slot of the pivoting cam when the weight component is in the home position, whereby the pivoting cam is permitted to rotate.

7. The inertia activated mechanism of claim 1, wherein The weight component is off-center to an axis of the cable when the weight is in a static position.

8. The inertia activated mechanism of claim 3, wherein the locking tab is prevented from moving back to a position that permits the pivoting cam to rotate.

9. The inertia activated mechanism of claim 1, wherein the spring comprises a coil spring.

10. The inertia activated mechanism of claim 1, wherein the cable is positioned within the spring.

11. The inertia activated mechanism of claim 4, wherein the locking tab allows the pivoting cam to rotate when the weight component is in the home position.

12. The inertia activated mechanism of claim 3, wherein the locking tab prevents the latch component from moving when the weight component travels away from the cone-shaped surface.

13. The inertia activated mechanism of claim 1, wherein the spring restrains the weight component in the home position when the crash force is not applied.

14. The inertia activated mechanism of claim 2, wherein the cone-shaped surface of the aperture and the cone-shaped section of the weight component are shaped to prevent the weight component from bending over when the crash force is applied.

15. The inertia activated mechanism of claim 1, wherein the weight component comprises a tube and a weight.

16. The inertia activated mechanism of claim 1, wherein the weight component comprises a barbell-shaped portion and a weight.

17. The inertia activated mechanism of claim 16, wherein the aperture includes a cone-shaped surface and wherein the barbell-shaped portion has a cone-shaped section.

18. An inertia activated assembly that resists unlatching of a door of a vehicle during a crash, comprising:

a housing defining a hole;

a weight component that includes an off-center weight, the weigh component operatively coupled to the housing through the hole that is displaced from a home position when a crash force is applied to the weight component;

a spring that restrains the weight component in the home position when the crash force is not applied;

a locking mechanism that prevents a pivoting cam of a latch mechanism from rotating when a crash force is applied; and a cable that attaches to the weight component and to the locking mechanism;

wherein the hole includes a cone-shaped surface and wherein the weight component has a cone-shaped section.

19. The inertia activated mechanism of claim 18, wherein the weight component moves at an angle to the housing when the weight component travels away from the housing.

20. The inertia activated mechanism of claim 19, wherein the pivoting cam comprises a knob, wherein a slot is located in the knob, and wherein the locking mechanism engages the slot when the weight component is displaced.

21. An inertia activated assembly that resists unlatching of a door of a vehicle during a crash, comprising:

a housing defining a hole;

a weight component that includes an off-center weight, the weight component operatively coupled to the housing through the hole that is displaced from a home position when a crash force is applied to the weigh component;

a spring that restrains the weight component in the home position when the crash force is not applied;

a locking mechanism that prevents a pivoting cam of a latch mechanism from rotating when a crash force is applied; and a cable that attaches to the weight component and to the locking mechanism, wherein the cable is positioned within the spring.

22. The inertia activated mechanism of claim 21, wherein the locking mechanism allows the pivoting cam to rotate when the weight component is in the home position.

23. The inertia activated mechanism of claim 22, wherein the locking mechanism prevents the latch mechanism from moving when the weight component travels away from the housing.

24. A door mechanism that resists unlatching of a vehicle door during a crash of an associated vehicle, comprising:

a door handle assembly further comprising a pivoting cam that unlatches the vehicle door when the pivoting cam rotates;

an inertia activated assembly further comprising:

a housing that forms a hole;

a weight component that is permitted to travel in the hole that is displaced from a home position when a force is applied to the weight component;

a spring that restrains the weight component in the home position when the force is not applied;

a locking tab that prevents the pivoting cam from rotating when the locking tab engages the pivoting cam; and a cable that attaches to the weight component and to the locking tab, that causes the locking tab to engage the cam when the weight component is displaced.

25. The door mechanism of claim 24 wherein the weight component includes an off-center weight.

26. The door mechanism of claim 24 wherein the pivoting cam includes a knob defining a slot.

27. The door mechanism of claim 26 wherein the locking tab engages the slot of the pivoting cam when a force is applied.

28. The door mechanism of claim 27, wherein the hole includes a cone-shaped surface and wherein the weight component has a cone-shaped section.

29. The door mechanism of claim 28, wherein the weight component moves at an angle to the housing when the weight component travels away from the home position.

30. The door mechanism of claim 24, wherein the inertia activated assembly is disposed in the door handle assembly.

31. The door mechanism of claim 27, wherein the locking tab allows the pivoting cam to rotate when the weight component is in the home position.

32. The door mechanism of claim 31, wherein the locking tab prevents the door from opening when the weight component travels away from the home position.

* * * * *